US006843436B1

(12) United States Patent
Simonds

(10) Patent No.: US 6,843,436 B1
(45) Date of Patent: Jan. 18, 2005

(54) CHOPPER PUMP

(75) Inventor: Edward L. Simonds, Adel, IA (US)

(73) Assignee: Thermal Dynamics, Inc., Adel, IA (US)

( * ) Notice: Subject to any disclaimer, the term of this patent is extended or adjusted under 35 U.S.C. 154(b) by 32 days.

(21) Appl. No.: 10/242,337

(22) Filed: Sep. 11, 2002

(51) Int. Cl.[7] ..... B02C 1/08
(52) U.S. Cl. ..... 241/242; 241/205; 241/290
(58) Field of Search ..... 241/242, 205, 241/283, 290

(56) References Cited

U.S. PATENT DOCUMENTS

| | | | | |
|---|---|---|---|---|
| 550,071 | A | * 11/1895 | Hundenburn et al. | 241/92 |
| 1,115,470 | A | 10/1914 | Lipman | |
| 1,423,867 | A | * 7/1922 | Winston et al. | 241/167 |
| 1,492,456 | A | 4/1924 | Hansen-Ellehammer | |
| 2,295,117 | A | 9/1942 | Koester | |
| 2,463,155 | A | 3/1949 | Dawes | |
| 2,636,480 | A | 4/1953 | Becker | |
| 2,671,411 | A | 3/1954 | Rhine | |
| 2,799,371 | A | 7/1957 | Osborn | |
| 3,368,537 | A | 2/1968 | Antonio | |
| 3,455,245 | A | 7/1969 | Reichling | |
| 3,787,150 | A | 1/1974 | Sarich | |
| 3,804,562 | A | 4/1974 | Hansson | |
| 3,812,828 | A | 5/1974 | Griffiths | |
| 3,828,555 | A | 8/1974 | Capdevielle | |
| 3,938,426 | A | 2/1976 | Hunter | |
| 3,988,083 | A | 10/1976 | Shimizu et al. | |
| 3,989,426 | A | 11/1976 | Sato et al. | |
| 4,241,713 | A | 12/1980 | Crutchfield | |
| 4,712,789 | A | 12/1987 | Brilando | |
| 4,757,988 | A | 7/1988 | Szymski | |
| 4,789,317 | A | 12/1988 | Waser et al. | |
| 4,898,524 | A | 2/1990 | Butzen | |
| 4,902,001 | A | 2/1990 | Balbo | |
| 4,986,402 | A | 1/1991 | Neuwirth | |
| 4,998,868 | A | 3/1991 | Sakamaki et al. | |
| 5,002,473 | A | 3/1991 | Sakamaki et al. | |
| 5,011,390 | A | 4/1991 | Sakamaki et al. | |
| 5,030,074 | A | 7/1991 | Sakamaki et al. | |
| 5,195,685 | A | * 3/1993 | Dumaine | 241/242 |
| 5,284,427 | A | 2/1994 | Wacker | |
| 5,461,863 | A | 10/1995 | Simonds | |
| 5,533,566 | A | 7/1996 | Fineblum | |
| 5,551,854 | A | 9/1996 | Edwards | |
| 5,617,936 | A | 4/1997 | Nemoto | |
| 5,816,789 | A | 10/1998 | Johnson | |
| 5,961,310 | A | 10/1999 | McClure | |
| 5,967,016 | A | 10/1999 | Simonds | |
| 5,974,943 | A | 11/1999 | Simonds | |
| 6,024,549 | A | 2/2000 | Lee | |
| 6,203,041 | B1 | 3/2001 | Helm | |
| 6,453,793 | B1 | 9/2002 | Simonds | |
| 6,481,650 | B1 | * 11/2002 | Mori | 241/24.15 |
| 6,634,581 | B2 | * 10/2003 | Rutz | 241/101.742 |

FOREIGN PATENT DOCUMENTS

| | | |
|---|---|---|
| DE | 2029 280 | 6/1970 |
| DE | 4341394 A | 4/1994 |
| FR | 2169500 A | 9/1973 |
| GB | 392999 | 6/1933 |
| GB | 743 088 A | 1/1956 |
| JP | 61-83492 A | 9/1984 |
| JP | 01-290924 A | 5/1988 |
| WO | WO 82/01215 | 4/1982 |

* cited by examiner

*Primary Examiner*—Mark Rosenbaum
(74) *Attorney, Agent, or Firm*—Brett Trout

(57) ABSTRACT

A pump for moving a solid containing fluid. The pump is provided with a plurality of vanes passing by an anvil. The vanes act as blades, chopping the solid waste into smaller portions as the vane passes by the anvil. The pump may be provided with a plurality of anvils or a serrated edge to divide the solid waste as finely as desired.

18 Claims, 8 Drawing Sheets

CHOPPER PUMP

BACKGROUND OF THE INVENTION

1. Field of the Invention

The present invention relates in general to a pump for pumping a fluid which also chops solid material into smaller pieces, more suitable for transport and/or treatment.

2. Description of the Prior Art

It is known in the art to provide a pumping system for transporting sewage or other fluid containing solids. However, such pumping systems typically must be provided with a filter system to remove the solid waste prior to pumping. Although filter systems are often sufficient to prevent such clogging, the filters themselves often become clogged and must be cleaned or replaced often to facilitate the clean flow of fluid to the pump. Alternatively, an impeller system may be employed to chop the solids to prevent them from damaging or clogging the pumping system. Such impeller type systems used to chop the solid waste are typically adequate to chop the solid waste sufficiently fine to prevent damage to the pump system. Such impeller systems, however, are expensive and complicated to manufacture and typically require the input of an additional power source to run them.

Based on the foregoing, it would be desirable to provide a pumping system which did not require a screen or separate impeller system to prevent solid waste from causing damage to the pump. The difficulties encountered in the prior art discussed hereinabove are substantially eliminated by the present invention.

SUMMARY OF THE INVENTION

In an advantage provided by this invention, the pumping system is provided which does not require screens or filters.

Advantageously, this invention provides a pumping system for chopping solid waste as solid waste containing fluid is pumped from one area to another.

Advantageously, this invention provides a solid waste and fluid pumping system which is low cost and simple to manufacture.

Advantageously, this invention provides a solid waste and fluid pumping system which is efficient to operate.

Advantageously, this invention provides a solid waste and fluid pumping system which reduces clogging and maintenance.

Advantageously, in the preferred example of this invention, a waste chopper is provided comprising a housing defining an input and output in fluid communication with the interior. An anvil is provided within the interior and means are also provided for rotating a blade with a sufficient amount of momentum relative to the anvil to divide waste between the blade and the anvil. In the preferred embodiment, a drum is provided on the interior with a plurality of extending and retracting blades which divide solid waste passing through the pump against the plurality of anvils provided on the housing.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
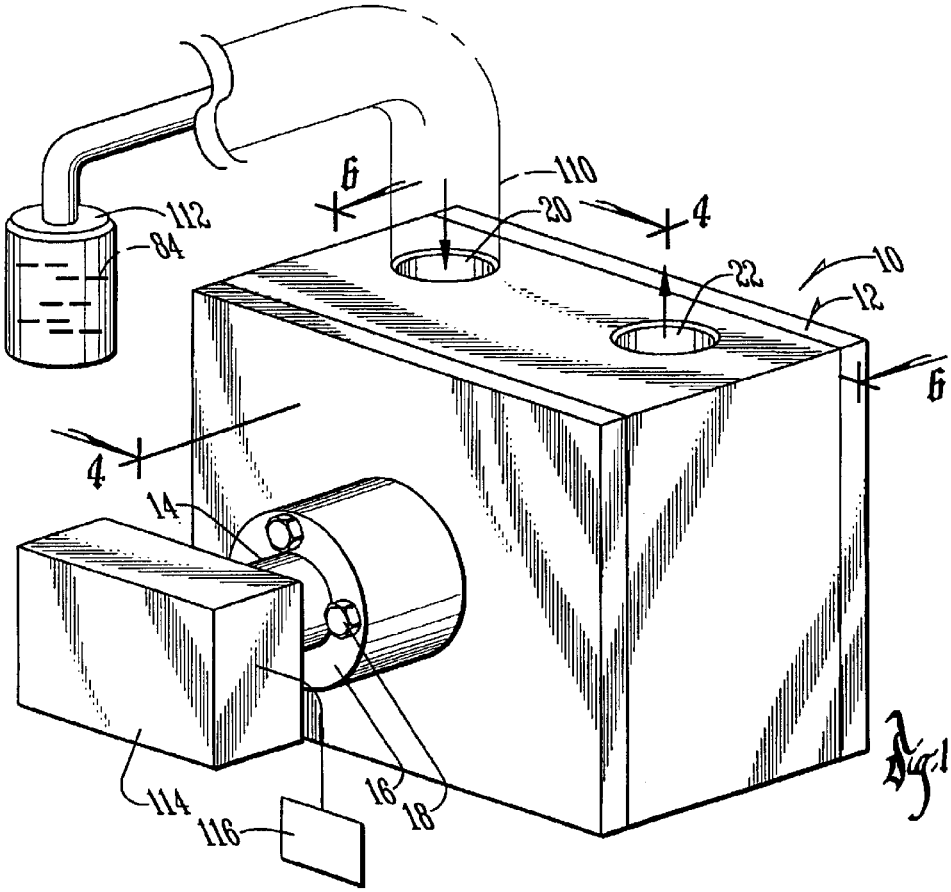
FIG. 1 illustrates an example perspective view of a pumping system of a pump according to this invention.
Figure 2:
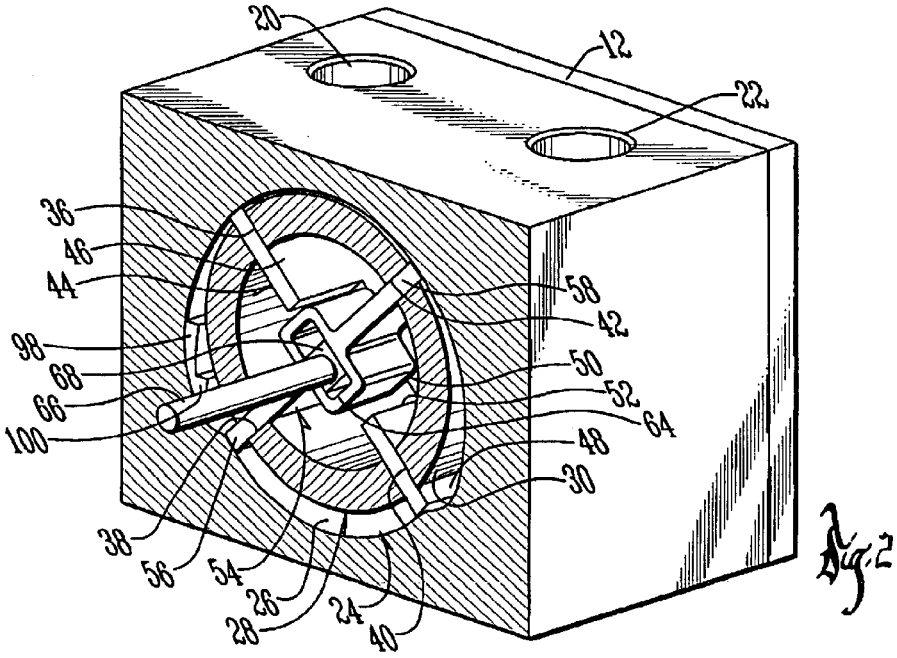
FIG. 2 illustrates a rear perspective view of the pump of FIG. 1, shown with the rear of the case and shaft bushings removed.
Figure 4:
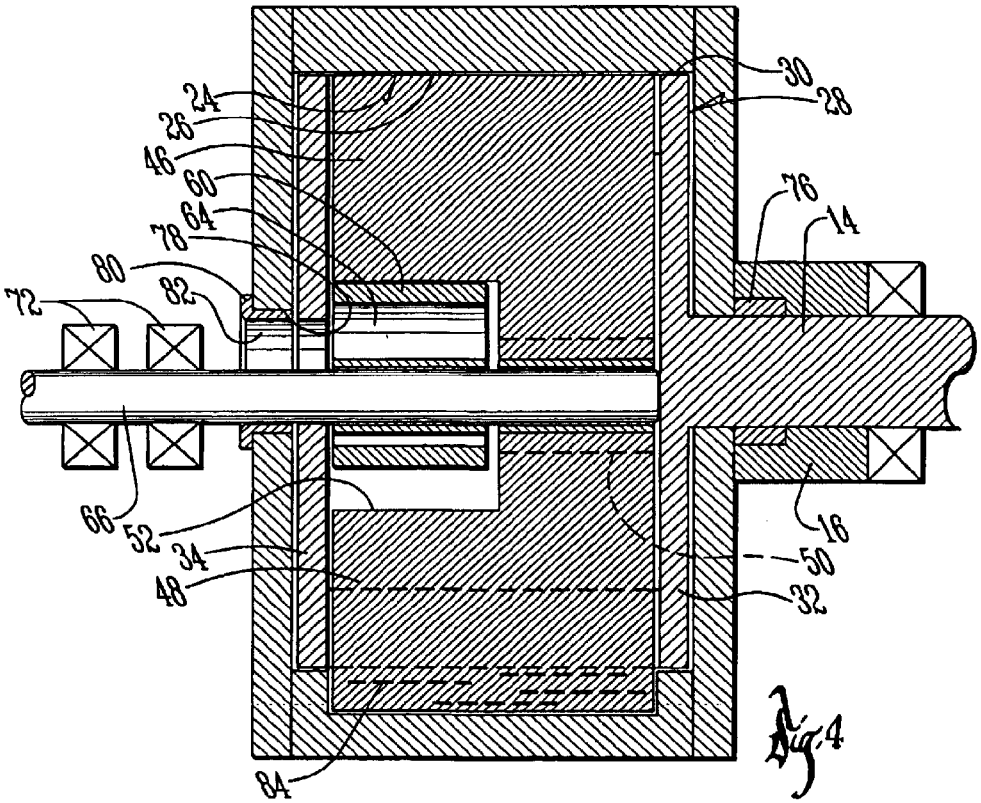
FIG. 4 illustrates a side elevation in cross section of the pump taken along line 4—4 of FIG. 1, shown with the vanes in maximum extension and maximum retraction orientation.

Referring to FIG. 1, a pump (10) according to this invention is shown with a drive shaft (14) coupled to a casing (12) by a bushing (16). The bushing (16), in turn, is secured to the casing (12) by bolts (18). As shown in FIG. 2, the casing (12) is provided with a fluid inlet (20) and a fluid outlet (22). The casing (12) is provided with a hollow interior (24) in fluid communication with the inlet (20) and outlet (22). The hollow interior (24) is defined by an outer race (26). Provided within the hollow interior (24) is an inner drum (28) which comprises a front plate (32), a back plate (34), and a cylindrical inner race (30). (FIGS. 2 and 4).

Figure 5:
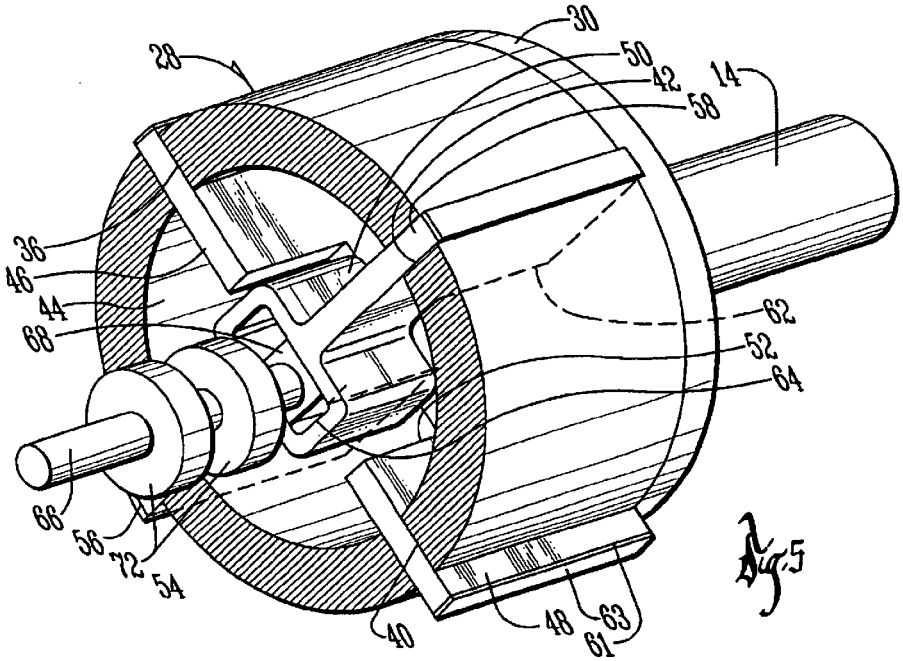
FIG. 5 illustrates a rear perspective view of the drum and vane assembly of the pump of FIG. 1.

As shown in FIG. 2, the inner race (30) is provided with a first aperture (36), a second aperture (38), a third aperture (40) and a fourth aperture (42). Provided within the inner drum (28) is a first vane assembly (44) which includes a first vane (46) and a third vane (48), each secured to a lost motion linkage (50). (FIG. 5). As shown in FIG. 4, the first vane (46) and third vane (48) are wider than the first lost motion linkage (50), leaving a first C-shaped cutout (52) in the first vane assembly (44). A second vane assembly (54) is also provided, comprising a second vane (56), a fourth vane (58) and a second lost motion linkage (60). (FIG. 5). The second vane (56) and fourth vane (58) are secured to the second lost motion linkage (60) in a manner similar to that described above to provide a second C-shaped cutout (62).

The first vane assembly (44) and second vane assembly (54) are constructed in a manner which positions the first vane (46) and third vane (48) perpendicular to the second vane (56) and fourth vane (58). The first lost motion linkage (50) is provided within the second C-shaped cutout (62) of the second vane assembly (54), and a second lost motion linkage (60) is provided within the first C-shaped cutout (52) of the first vane assembly. Preferably, the vane assemblies (44) and (54) are constructed of stainless steel and are provided near their ends (61) with wear resistant tips (63), constructed of an aluminum nickel bronze alloy, such as those alloys known in the art, or of other known wear resistant material. The tips (63) are secured to the vane assemblies (44) and (54) by weldments or similar securement means.

Figure 6:
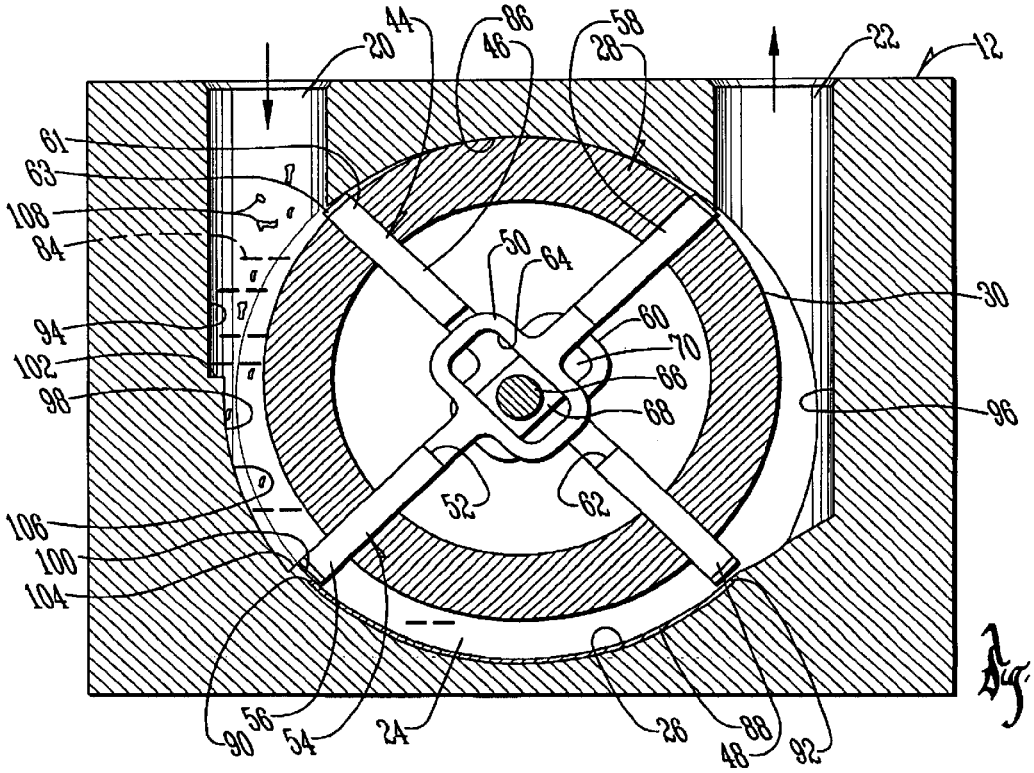
FIG. 6 illustrates a rear elevation cross-section of the motor of FIG. 1, showing the first vane at the beginning of the push stroke.

As shown in FIG. 6, the first lost motion linkage (50) defines an interior space (64) with a width approximately one-half of its length. Provided within this interior space (64) is a stainless steel drum shaft (66). Secured around the drum shaft (66) is a guide block (68). The guide block (68) has a square cross-section with a width only slightly smaller than the width of the interior space (64) defined by the first lost motion linkage (50). The guide block (68) is preferably the same depth as the vanes (46), (48), (56) and (58), and extends from the interior space (64) of the first lost motion linkage into an interior space (70) defined by the second lost motion linkage (60). This construction allows longitudinal movement of the vane assemblies (44) and (54) relative to the guide block (68) and drum shaft (66), but prevents lateral movement in relationship thereto. (FIGS. 2 and 4)

Figure 3:
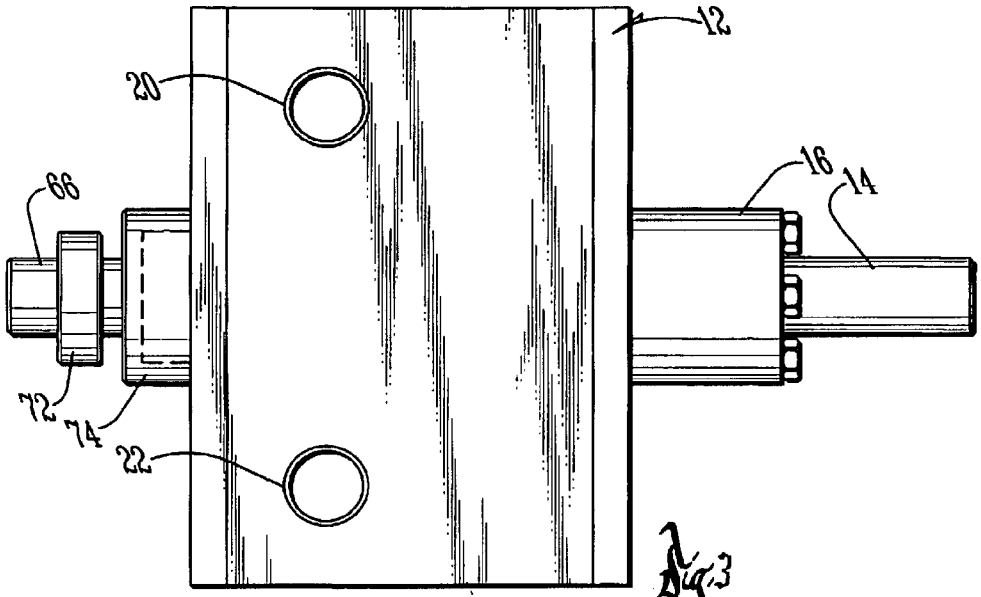
FIG. 3 illustrates a top plan view in partial phantom of the pump of FIG. 1.

As shown in FIGS. 1, 3 and 4, provided around the drum shaft (66) are a pair of bearings (72), such as those known in the art, secured to a pair of support brackets (74). As shown in FIG. 6, the drum shaft (66) is centered within the hollow interior (24) defined by the outer race (26). As can be seen in FIG. 4, the drive shaft (14) is positioned slightly higher than the drum shaft (66). The drive shaft (14) is centered on the front plate (32) and secured thereto by a locking collar (76). Accordingly, the drive shaft (14) is parallel to, but on a different axis than, the drum shaft (66).

Since the shafts (14) and (66) each rotate on a different axis, the back plate (34) must be provided with a large circular aperture (78) into which is secured a bearing (80). The bearing (80) supports the inner drum (28) against the casing (12) and allows the drum shaft (66) to extend out of the casing (12) and rotate on its own axis. The bearing (80) also maintains a substantially fluid tight seal to prevent the escape of solid waste containing fluid (84) out of the casing (12).

As shown in FIG. 6, the inner race (30) is positioned very close to a ceiling (86), defined by the casing (12). In the preferred embodiment, the curvature of the ceiling (86) is less than the curvature of the inner race (30). The inner race (30) is preferably positioned within five millimeters of, and more preferably, within one millimeter of the ceiling (86) to limit the flow of solid waste containing fluid (84) therebetween. The inner race (30) is preferably positioned no closer than 1/100th of a millimeter to the ceiling (86) and, more preferably, positioned no closer than 1/10th of a millimeter to the ceiling (86) to reduce wear on the tips (63) of the vane assemblies (44) and (54), and to prevent solid waste (108) from damaging the pump (10).

The outer race (26) is provided with an abrasion plate (88), preferably constructed of titanium or similar abrasion resistant material. As shown, the casing (12) is provided with a first slot (90) and a second slot (92) into which the ends of the abrasion plate (88) are friction fit. As noted above, and shown in FIG. 6, the inner race (30) has a tighter radius of curvature than the ceiling (86). This provides a widening area for the vanes (46), (48), (56) and (58) to extend and retract relative to the outer race (26). As shown in FIG. 6, the casing (12) defines an intake sidewall (94) and an exhaust sidewall (96).

As shown in FIG. 6, provided along the intake sidewall (94) are a first anvil (98) and a second anvil (100). While the anvils (98) and (100) may be of any suitable size or construction, in the preferred embodiment the anvils (98) and (100) are constructed of titanium or similar wear resistant material, and are each provided with a leading edge (102). Preferably, the leading edge (102) is provided with an angle between 45 and 100 degrees, more preferably less than 90 degrees and, most preferably, below 80 degrees. As shown in FIG. 6, the leading edge (102) of the first anvil (98) is further from the path of travel of the vanes (46), (48), (56) and (58) than the trailing edge (104) of the second anvil (100). In the preferred embodiment, the leading edge (102) of the first anvil (98) is preferably less than ten centimeters from the path of travel of the vanes (46), (48), (56) and (58), more preferably less than five centimeters, and most preferably, less than one centimeter from the path of travel. Similarly, in the preferred embodiment, the trailing edge (104) of the second anvil (100) is preferably less than eight centimeters from the path of travel of the vanes (46), (48), (56) and (58), more preferably less than four centimeters, and most preferably less than eight millimeters from the path of travel. Preferably, the trailing edge (104) of the second anvil (100) is closer to the path of travel of the vanes (46), (48), (56) and (58) than the leading edge (102) of the first anvil (98), and is more preferably at least about ten percent closer to the path than the leading edge (102) of the first anvil (98). Although the leading edges (102) and (104) of the anvils (98) and (100) may be located any suitable distance from one another along the intake sidewall (94), in the preferred embodiment the leading edges (102) and (104) of the anvils (98) and (100) are located four centimeters from one another.

As shown in FIG. 6, the first anvil (98) and second anvil (100) form a recess (106) therebetween which may be provided with any suitable dimensions or with a curved surface to reduce the movement of solid waste (102) into the recess (106). In the preferred embodiment, the only two anvils (98) and (100) are used, it should be known that any number of anvils of any suitable dimensions and spacing may be used to practice the present invention.

When it is desired to utilize the pump (10) of the present invention, an intake hose (110) is secured over the fluid inlet (20) of the pump (10). The opposite end of the intake hose (110) is provided in a container (112) holding the solid waste containing fluid (84). A motor (114) is coupled to the drive shaft (14). Although the motor (114) may be of any suitable type known in the art, such as electric, gasoline or solar.

Figure 7:
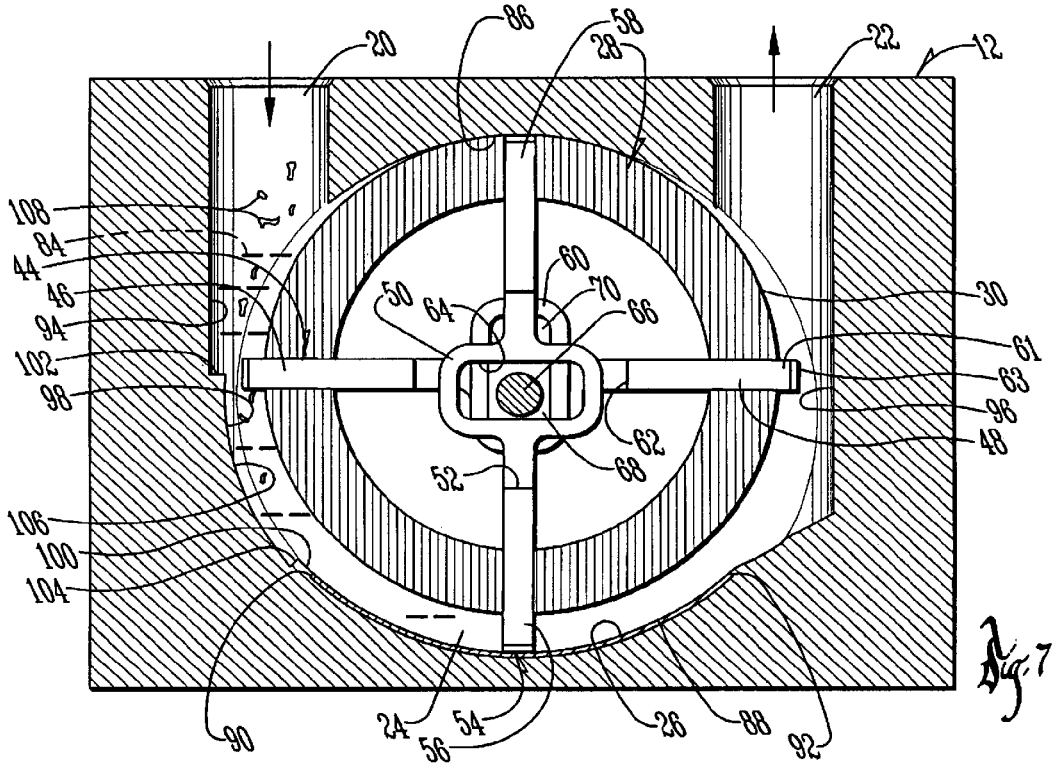
FIG. 7 illustrates a rear elevation cross-section of the motor of FIG. 1, showing the first vane partially extended through the push stroke in proximity to the first anvil.
Figure 8:
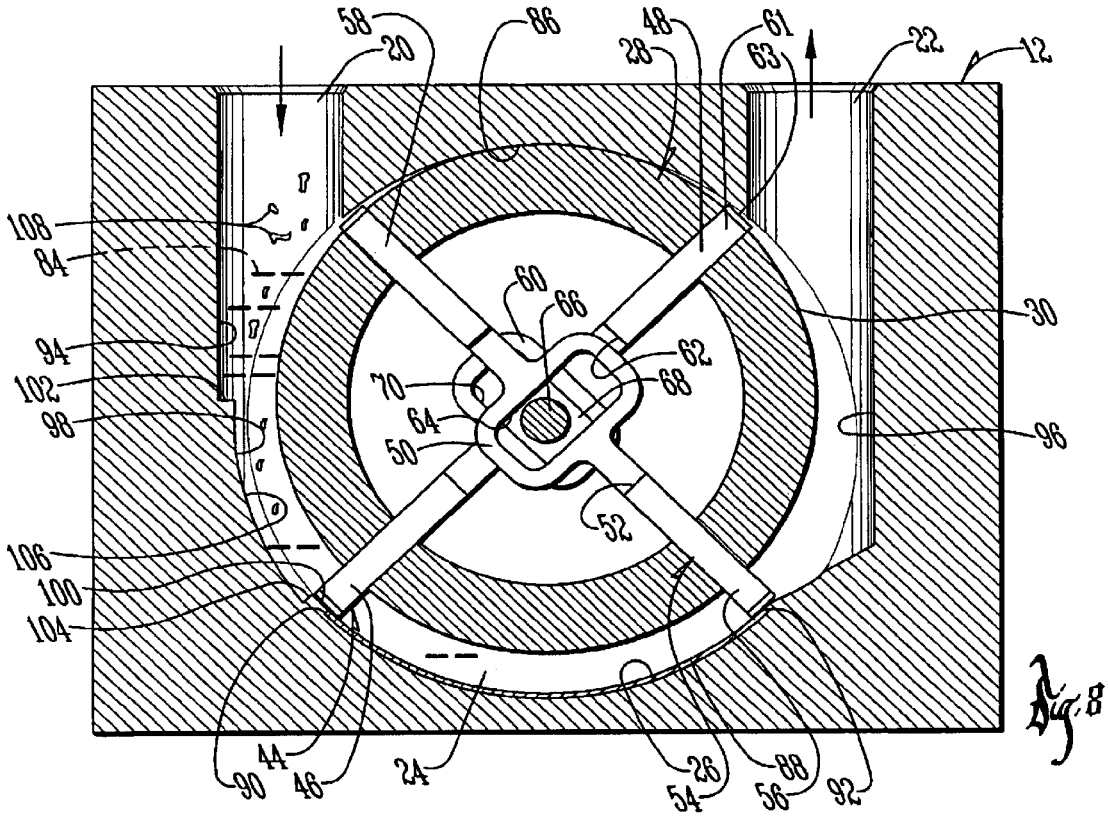
FIG. 8 illustrates a rear elevation cross-section of the motor of FIG. 1, showing the first vane in proximity to the second anvil.

As shown in FIG. 1, the motor (114) is coupled to a power source (116). Similarly, the power source (116) may be of any suitable source known in the art. In the preferred embodiment, the power source (116) is an alternating current source but the power source (116) may, of course, be a direct current or any similar type source known in the art. Once the intake hose (110) has been placed in the container (112), the motor (114) is actuated to turn the drive shaft (14). As shown in FIG. 6, as the drive shaft (14) turns the inner drum (28), the drum shaft (66) and guide block (68) alternately extend and retract the vanes (46), (48), (56) and (58) relative to the inner drum (28). As shown in FIGS. 6, 7 and 8, as the vanes (46), (48), (56) and (58) move across the abrasion plate (88), they push solid waste containing fluid (84) along their leading edge (102) and create a vacuum along their trailing edge (104), thereby drawing solid waste containing fluid (84) out of the container (112) and through the intake hose (110). (FIGS. 1, 6, 7 and 8).

As the solid waste containing fluid (84) enters the fluid inlet (20), the solid waste containing fluid (84) moves toward the anvils (98) and (100). As shown in FIG. 6, as the first vane (46) moves toward the first anvil (98), the guide block (68) begins to extend the first vane (46). As shown in FIG. 7, as the inner drum (28) continues to rotate, the first vane (46) extends and passes by the first anvil (98). As shown in FIG. 8, as the inner drum (28) continues to rotate, the first vane (46) passes by the second anvil (100). The motor (114) continues to rotate the inner drum (28), causing the first vane (46) to make an entire rotation around the drum shaft (66), extending as the first vane (46) passes the anvils (98) and (100), and the abrasion plate (88), and fully retracting as the first vane (46) passes the ceiling (86).

Figure 9A:
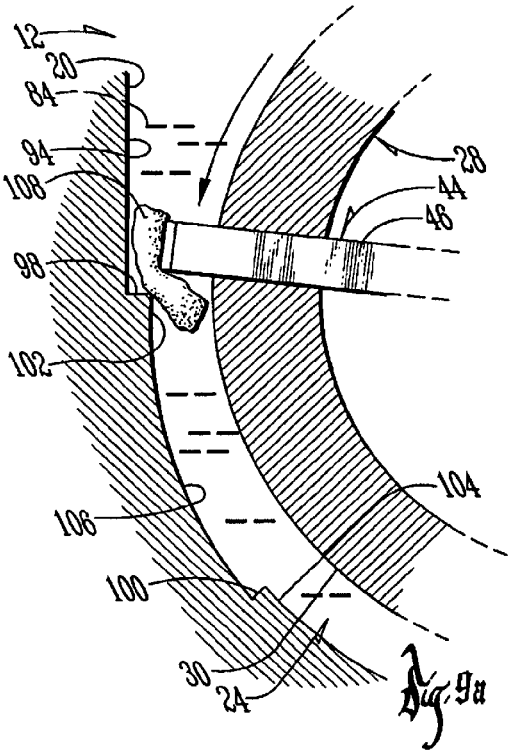
FIGS. 9A–C illustrate a rear elevation in partial cross-section of the first vane cutting solid waste against the first anvil.
Figure 9B:
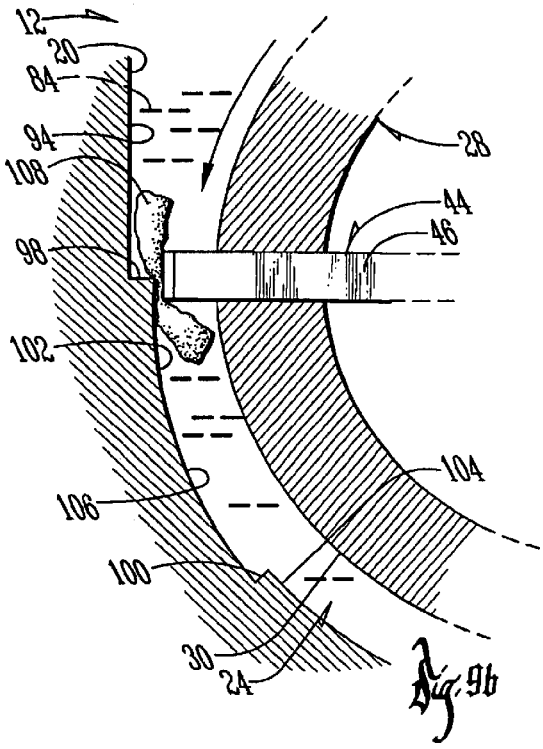
Figure 9C:
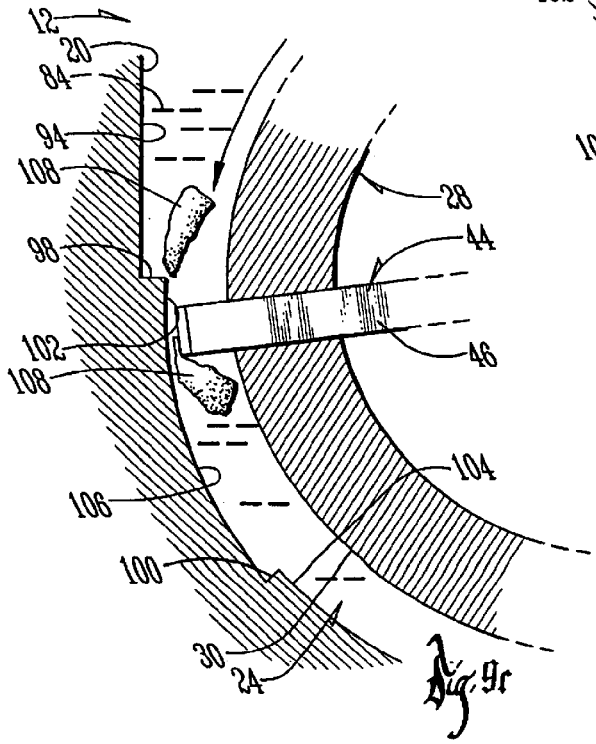
Figure 10A:
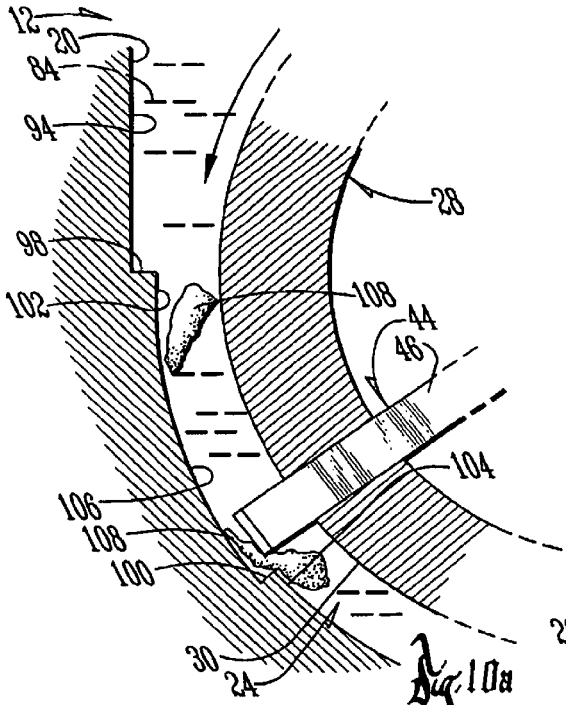
FIGS. 10A–C illustrate a rear elevation in partial cross-section of the first vane cutting solid waste against the second anvil.
Figure 10B:
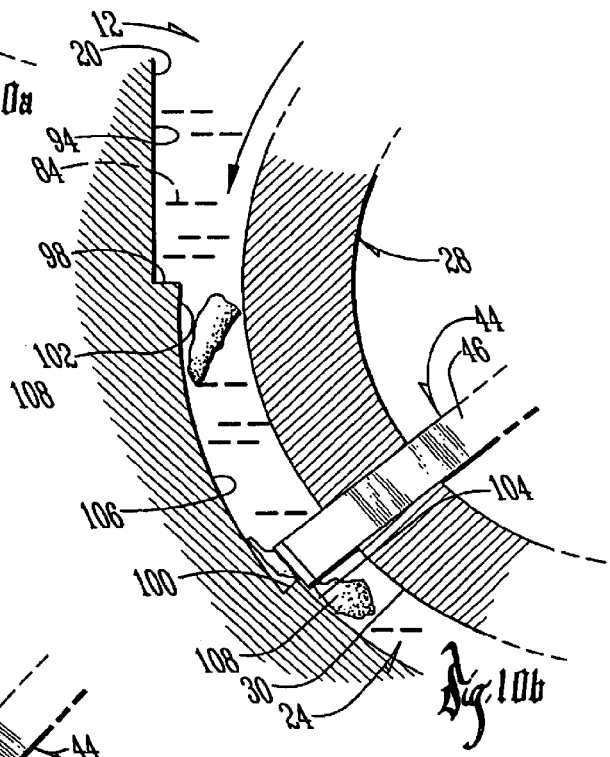
Figure 10C:
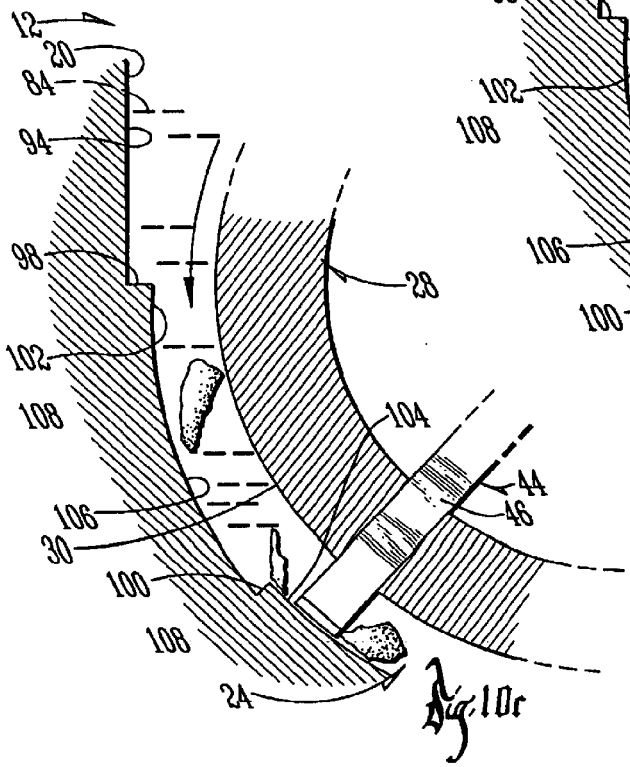

As shown in FIGS. 6–8, the diameter of the fluid inlet (20) is greater than the distance between the leading edge (102) of the first anvil (98) and the inner drum (28). Accordingly, as solid waste containing fluid (84) moves through the pump (10), some solid waste (108) may become lodged on the first anvil (98). As shown in FIGS. 9A–C, when a piece of solid waste (108) becomes lodged on the anvil (98), the first vane (46) acts as a blade, cutting the solid waste (108) as it passes by the first anvil (98) in its revolution. This action chops large portions of solid waste (108) into smaller portions sufficient to pass the remainder of the way through the pump (10). (FIGS. 1 and 9A–C). As shown in FIGS. 10A–C, the provision of the trailing edge (104) of the second anvil (100) closer to the path of travel of the first vane (46) will cause portions of solid waste (108) to collect near the second anvil (100) as well. Although these portions of solid waste (108) are likely smaller than those entering the fluid inlet (20) after being chopped by the first anvil (98), it still may be desirable to chop the solid waste (108) into even smaller portions. Accordingly, as the first vane (46) passes by the trailing edge (104) of the second anvil (100), the first vane (46) again acts as a blade, cutting the solid waste (108) into even smaller portions, each having less of a likelihood of clogging the pump (10) or any other fluid transport system. (FIGS. 1 and 10A–C).

Figure 11:
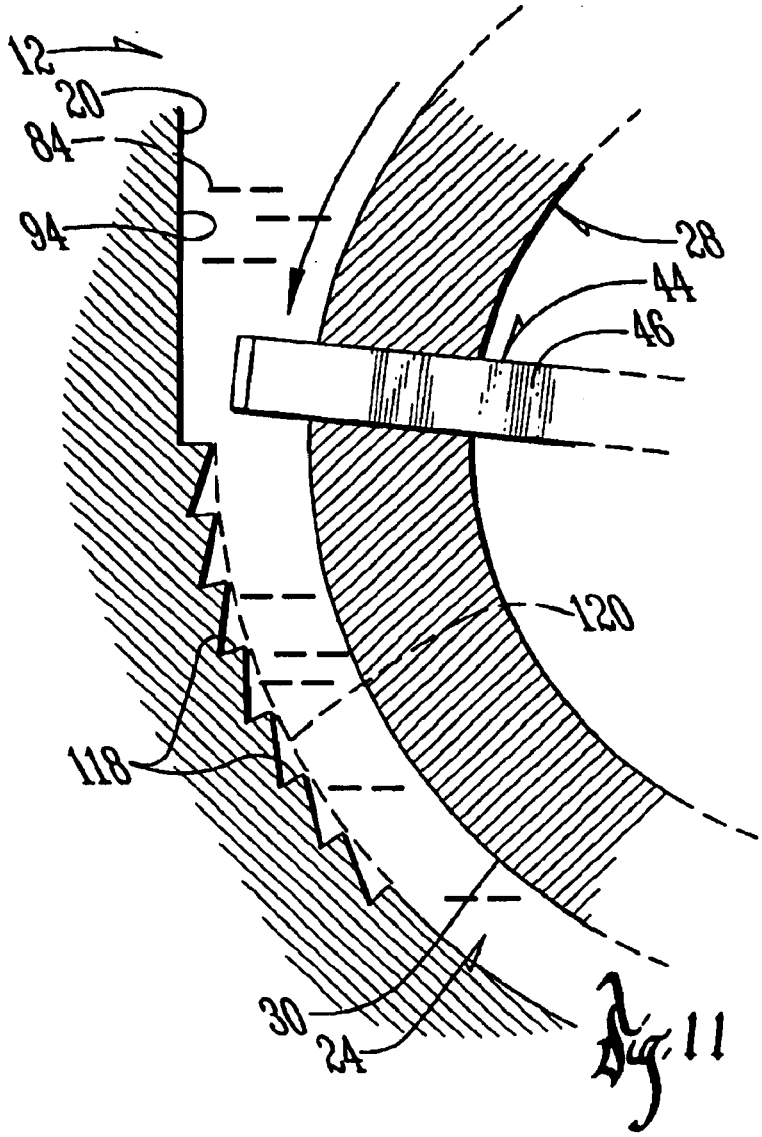
FIG. 11 illustrates a rear elevation in cross-section showing an alternative embodiment of the pump of the present invention utilizing a plurality of anvils.

An alternative embodiment of the present invention is shown in FIG. 11, wherein a plurality of anvils (118) forming a serrated edge (120) is provided in approaching proximity to the path of the first vane (46). Such a serration would allow solid waste (108) to be divided into increasingly smaller portions for transport and delivery.

Although the invention has been described with respect to a preferred embodiment thereof, it to be also understood that it is not to be so limited, since changes or modifications can be made therein which are within the full intended scope of this invention as defined by the appended claims. For example, it should be noted that the first vane assembly (44) and second vane assembly (54) may be replaced with a standard vane assembly or turbine assembly, or may be utilized in association with any type of vane assembly known in the art.

It is additionally anticipated that the pump (10) may be constructed of any suitable size, ranging from sizes less than a millimeter to several meters in diameter, although it is preferably constructed of a size greater than one cubic centimeter and smaller than one cubic meter. It is also anticipated that any suitable liquid, viscous liquid or solid containing liquid, or flowable solid, may be used with the pump (10) of the present invention.

What is claimed is:

1. A waste chopper comprising:

(a) a housing defining an input and an output in fluid communication with an interior, wherein said housing also defines an arcuate surface;

(b) a blade;

(c) an anvil provided within said interior;

(d) means for rotating said blade with sufficient momentum relative to said anvil to divide waste between said blade and said anvil and to drive waste out of said interior through said output; and (e) means for substantially preventing contact of said blade with said housing.

2. The waste chopper of claim 1, wherein said anvil comprises a cutting surface defining an angle less than seventy-five degrees.

3. The waste chopper of claim 1, wherein said anvil comprises a cutting surface defining an angle less than seventy-five degrees.

4. The waste chopper of claim 1, further comprising a supplemental blade coupled for movement sufficiently close to said anvil to divide waste between said supplemental blade and said anvil when driven.

5. The waste chopper of claim 4, further comprising a supplemental anvil.

6. The waste chopper of claim 5, wherein said supplemental anvil is located closer to a path of said blade than said anvil.

7. The waste chopper of claim 1, further comprising a supplemental anvil.

8. The waste chopper of claim 7, wherein said supplemental anvil is located closer to a circular path of said blade than said anvil.

9. A waste chopper comprising:

(a) a housing defining an input and an output in fluid communication with an interior, wherein said housing also defines an arcuate surface;

(b) a drum located within said interior, said drum defining a slot;

(c) a blade provided within said slot;

(d) means for rotating said inner drum;

(e) means for extending and retracting said blade relative to said inner drum;

(f) an anvil located sufficiently close to divide waste between said anvil and said blade as said blade passes said anvil; and (g) wherein said anvil comprises a cutting surface defining an angle less than ninety degrees.

10. The waste chopper of claim 9, further comprising means for substantially preventing contact of said blade with said housing.

11. The waste chopper of claim 9, wherein said drum further defines a supplemental slot and further comprising a supplemental blade provided within said supplemental slot.

12. The waste chopper of claim 9, further comprising means for substantially preventing contact of said supplemental blade with said anvil.

13. The waste chopper of claim 12, further comprising a second anvil.

14. The waste chopper of claim 13, wherein said anvil is located closer to a circular path of said blade than said supplemental anvil.

15. The waste chopper of claim 9, further comprising a second anvil.

16. The waste chopper of claim 9, wherein said anvil is located closer to a circular path of said blade than said supplemental anvil.

17. A waste chopper comprising:

(a) a housing defining an input and an output in fluid communication with an interior, wherein said housing also defines an arcuate surface;

(b) a drum provided within said interior, said drum provided with a first slot and a second slot;

(c) a first blade provided within said first slot and a second blade provided within said second slot;

(d) means for extending and retracting said first blade and said second blade relative to said drum;

(e) an anvil provided within sufficient proximity of a blade path to divide waste between said anvil and said first blade as said first blade passes said anvil; and (f) means for rotating said inner drum sufficiently to divide waste between said anvil and said first blade, and to motivate divided waste out of said interior through said output.

18. The waste chopper of claim 17, further comprising a supplemental anvil, wherein said anvil is located closer to a circular path of said blade than said supplement anvil.

* * * * *